United States Patent [19]

Williams et al.

[11] Patent Number: 4,572,080

[45] Date of Patent: Feb. 25, 1986

[54] MOVABLE STOPS FOR RAILWAY VEHICLES

[75] Inventors: Derrick G. Williams, Warwickshire; John Thurlow, Coventry; John J. Bushnell, Warwickshire, all of England

[73] Assignee: Oleo International Holdings Limited, England

[21] Appl. No.: 662,608

[22] PCT Filed: Mar. 19, 1984

[86] PCT No.: PCT/GB84/00087

§ 371 Date: Oct. 16, 1984

§ 102(e) Date: Oct. 16, 1984

[87] PCT Pub. No.: WO84/03671

PCT Pub. Date: Sep. 27, 1984

[30] Foreign Application Priority Data

Mar. 18, 1983 [GB] United Kingdom ..... 8307553

[51] Int. Cl.[4] ..... B61K 7/18

[52] U.S. Cl. ..... 104/252; 104/256; 188/32

[58] Field of Search ..... 104/249, 254, 256, 252; 188/32, 36, 111; 410/58–60, 62, 63

[56] References Cited

U.S. PATENT DOCUMENTS

| | | | |
|---|---|---|---|
| 3,799,064 | 3/1974 | Kikuchi et al. | 104/256 |
| 3,828,688 | 8/1974 | Bradbury | 104/252 |

FOREIGN PATENT DOCUMENTS

| | | |
|---|---|---|
| 0083038 | 7/1983 | European Pat. Off. . |
| 163791 | 10/1905 | Fed. Rep. of Germany . |
| 2169252 | 9/1973 | France . |
| 827587 | 2/1960 | United Kingdom . |
| 1045919 | 10/1966 | United Kingdom . |
| 1123981 | 8/1968 | United Kingdom . |
| 2050274 | 1/1981 | United Kingdom . |
| 2056389 | 3/1981 | United Kingdom . |

*Primary Examiner*—Randolph A. Reese

*Attorney, Agent, or Firm*—Parkhurst & Oliff

[57] ABSTRACT

Movable buffer stop apparatus (10) for a railway vehicle comprises a stop plate (27) on an arm (21), and a support strut (31) movable angularly relative to the arm (21) by an hydraulic cylinder (33) between raised and lowered conditions of the apparatus (10). The arm (21) and the support strut (31) are mounted on a truck (14) which cooperates with a fixed energy absorbing buffer (35) in a sunken pit (11).

13 Claims, 9 Drawing Figures

MOVABLE STOPS FOR RAILWAY VEHICLES

DESCRIPTION

This invention relates to movable buffer stop apparatus for railway vehicles on a railway track, such as are used in railway marshalling yards, the apparatus including a stop which is movable between an operational location in which it is located in the path of a buffer of a railway vehicle on the track, and another location in which it leaves that path clear for through passage of a railway vehicle and for track maintenance.

UK-A-2056389 discloses an arrangement of movable buffer stop which comprises an hydraulic buffer which is mounted on massive support structure, the support structure being pivotable by extension or contraction of a telescopic hydraulic cylinder between its position in which the hydraulic buffer is located in tne path of the respective railway vehicle buffer and its stowing location, by pivotal movement of the support structure about a pivot axis which is substantially parallel to an adjacent railway line. Apart from the obvious disadvantages that follow from the necessary massive support structure, there is an additional disadvantage that, in practice, the stop can only be used as one of a pair of such stops, each cooperating with a respective one of a pair of buffers which are mounted adjacent the sides of a railway vehicle, and is not suitable for use to stop the kind of railway vehicle which has a single, centrally-located buffer. Also a considerable space between adjacent tracks has to be provided to allow stowage of the apparatus. Furthermore a powerful hydraulic cylinder has to be employed for moving the apparatus between the operational and stowing locations.

FR-A-2169252 and US-A-3828688 each disclose movable buffer stop apparatus comprising a single stop mounted at one end of an arm positioned between the rails of a railway track and pivotably mounted so as to be movable generally in the direction of the track to move the stop to and from its operational location in which it is positioned in the path of a centrally-located buffer of a railway vehicle moving on the track. The arm of the apparatus disclosed in FR-A-2169252 is fulcrumed on the buffer plunger of an hydraulic energy absorbing buffer and is movable about that fulcrum to and from the position in which it locates the stop in its operational location by an hydraulic cylinder which acts at the other end of the arm remote from the stop. This arrangement has the disadvantage that the hydraulic cylinder is loaded by reaction to an impact load to which the stop is subjected by a moving railway vehicle. That problem is avoided by the arrangement disclosed by US-A-3828688 but at the expense of substantial complexity. Although there are two energy absorbing devices arranged in parallel to share the impact loads, they take those loads in tension which limits the loads that can be taken without the apparatus disintegrating. Hence this apparatus is unsuitable for use to stop large freight wagons of the sizes currently being used.

An object of this invention is to provide movable buffer stop apparatus which can be adapted for use to stop moving railway vehicles which are fitted with buffers either singly at the center or in pairs at the sides of the vehicle and which does not suffer from the disadvantages of the known forms of movable buffer stop apparatus discussed above.

According to one aspect of this invention there is provided movable buffer stop apparatus for a railway vehicle on a railway track, the apparatus comprising an energy absorbing device which is fixed relative to the track when the apparatus is installed for use, a movable stop, a load bearing member and actuating means operable, when the apparatus is installed for use, to move the stop generally in the direction of the track between an operational location in which it is located in the path of a railway vehicle on the track and in which it is associated with the load bearing member such that impact of the stop by a railway vehicle moving on the track is transmitted to the energy absorbing device through the load bearing member and taken by the energy absorbing device in compression, and another location in which the apparatus leaves the path clear for through passage of a railway vehicle and track maintenance, wherein the movable stop, the load bearing member which is a strut, and the actuating means are mounted on a truck which, when the apparatus is used, runs on a track which is sunken relative to the railway track, the truck coacting with the energy absorbing device so that energy transmitted to the truck through the load bearing member as a result of impact of the stop by a railway vehicle moving on the railway track is absorbed by the energy absorbing device, and the actuating means are operable to move the stop into its operational location by moving the strut into a position in which it transmits impact forces to the truck in compression without the actuating means being loaded by those forces.

According to another aspect of this invention there is provided movable buffer stop apparatus for a railway vehicle, comprising a stop which is carried by an arm which is movable between one position in which the stop is located in an operational location in the path of a railway vehicle, and a second position in which it leaves that path clear for through passage of a railway vehicle and for track maintenance, the arm being supported in its said one position by a strut which is positioned by a linear actuator such that, when the stop apparatus is installed for use, action and reaction forces due to impact of the stop by a railway vehicle are transmitted between the stop and the ground structure which is fixed relative to the rails on which the vehicle runs through the stop and the strut, as well as through an associated energy absorbing device, generally in the direction of movement of the vehicle without the linear actuator being loaded by those forces, wherein the strut is pivotally mounted for angular movement about an axis which is spaced from a part of it which supportingly engages the arm, that strut part being in laterally displaceable abutment with the arm at least when the arm is in its said one position, and the arm resting upon the strut so that it is raised and lowered between its said one position and its second position by angular movement of the strut.

Various forms of movable buffer stop apparatus in which this invention is embodied will be described now by way of example, with reference to the accompanying drawings, of which:

Figure 1:
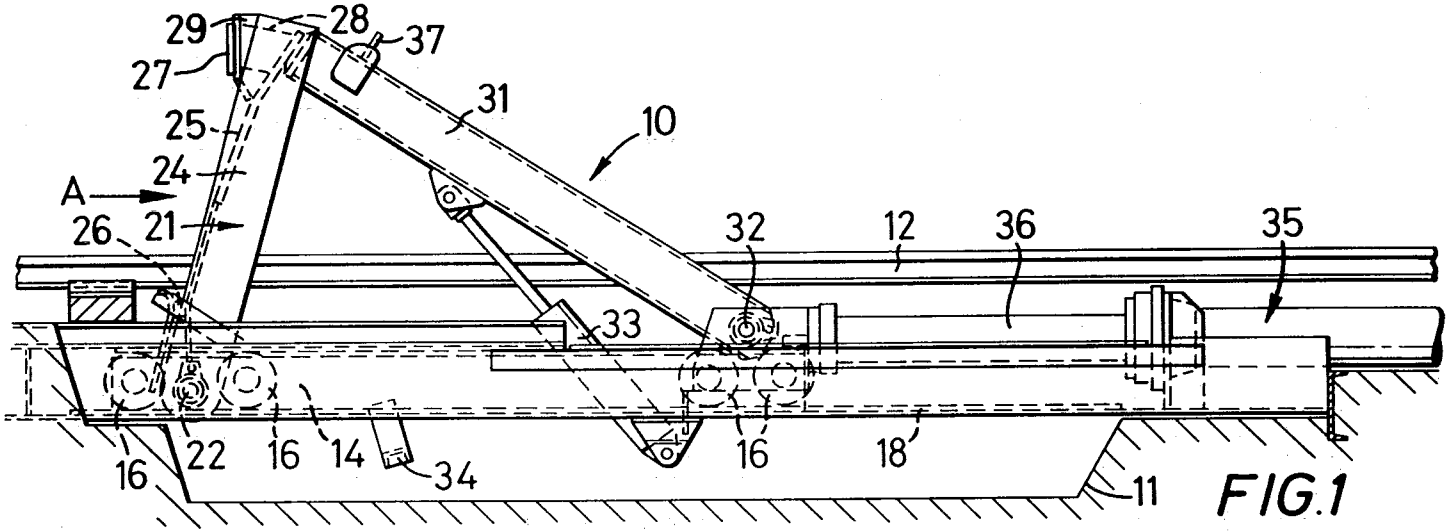
FIG. 1 is a side elevation of a movable buffer stop installation with the apparatus erected to stop a moving railway vehicle having a centrally mounted buffer, or to hold such a railway vehicle on a gradient.
Figure 2:
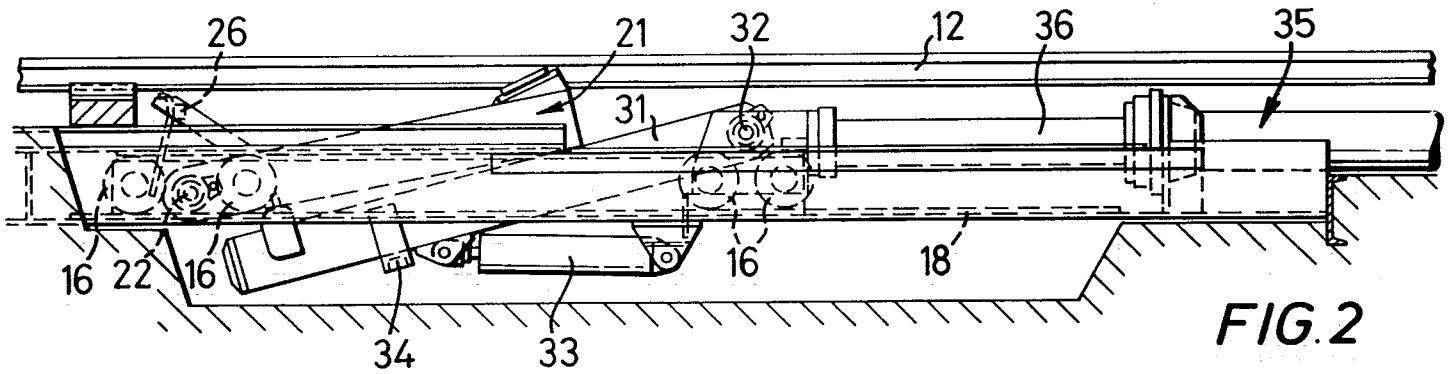
FIG. 2 is a side elevation of the movable buffer stop installation shown in FIG. 1, with the apparatus collapsed so that it is stowed out of the path of a moving railway vehicle on the respective track.
Figure 3:
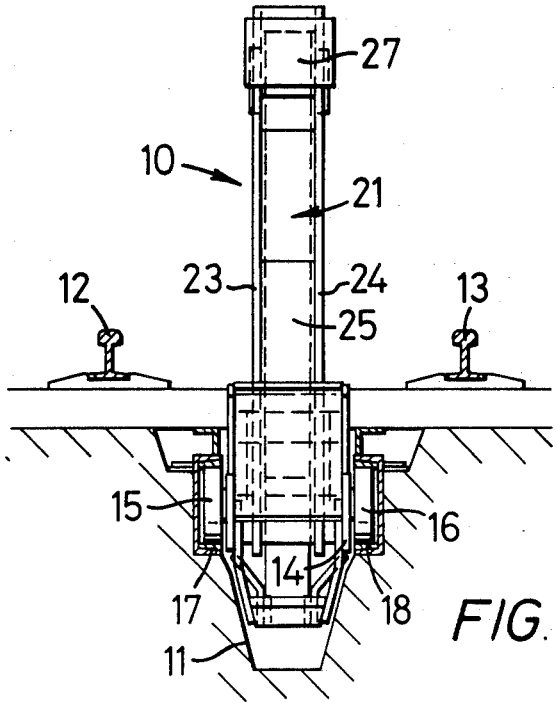
FIG. 3 is a view on Arrow A of FIG. 1.

FIGS. 1 to 3 show movable buffer stop apparatus 10 installed in a pit 11 which is formed between rails 12 and 13 of a railway track and which extends along the track.

The apparatus 10 comprises a truck 14 having wheels 15 and 16 which run on tracks 17 and 18 located in recesses formed in the sides of the pit 11.

An arm 21 is hinged at one end to the truck 14 by a pivot mounting 22 for angular movement about a substantially horizontal axis which is substantially transverse to the rails 12 and 13. The arm 21, which is a fabricated structure, comprises a spaced pair of parallel side plates 23 and 24 and a web 25 which bridges the gap between the side plates 23 and 24. The web 25 is not flat but is formed from a number of juxtaposed flat portions which include shallow angles between them at their abutting edges. Hence the web 25 approximates to an arcuate web, forming a shallow substantially arcuate concave face.

A fixed stop 26 mounted on the truck 14 near to the pivot mounting 22, cooperates with a portion of the convex surface of the web 25 to limit angular movement of the arm 21 relative to the truck 14 to less than 90° from the horizontal.

A stop plate 27 is rigidly mounted at the end of the arm 21 remote from the pivot mounting 22 by a strut 28, which projects from the convex face of the web 25, and is further supported by two triangular reinforcing plates 29 which are fixed one to each side plate 23, 24.

A support strut 31 is pivotally mounted at 32 on the truck 14. The pivot mounting 32 is displaced from the pivot mounting 22 of the arm 21 in the direction of Arrow A in FIG. 1.

An hydraulic cylinder 33 has its cylinder casing pivotally mounted on the truck 14 and its rod pivotally connected to the support strut 31 at a location between the ends of the support strut 31. Extension and contraction of the hydraulic cylinder 33 moves the support strut 31 about its pivot mounting 32 through an angular range of less than 90°. The support strut 31 extends from its pivot mounting 32 generally towards the pivot mounting 22 throughout its range of angular movement.

The limits of angular movement of the support strut 31 are shown in FIGS. 1 and 2 respectively. FIG. 1 shows that, when the hydraulic cylinder 33 is extended fully, the end of the support strut 31 remote from its pivot mounting 32 is engaged with the concave face of the web 25 at the end of the arm 21 remote from its pivot mounting 22 and substantially opposite to the reinforcing strut 28. The effective radius of a portion of the concave face of the web 25 that extends towards the pivot mounting 22 from the end of the arm 21 remote from the pivot mounting 22 is substantially equal to the length of the support strut 31. Hence the arm 21 hardly moves during the first part of angular movement of the support strut 31 towards the truck 14, from its position shown in FIG. 1, since the end of the support strut 31 remote from its pivot mounting 32 is in rubbing contact with that portion of the concave face of 25. That first part of angular movement of the support strut 31 is approximately half the total range of angular movement of the support strut 31. The end of the support strut 31 remote from the pivot mounting 32 separates from the web 25 after it has swept that portion of the concave face of the web 25 during contraction of the hydraulic cylinder. The arm 21 follows further angular movement of the support strut 31 and other parts of the arm 21, including a projection 37, rest upon other parts of the support strut 31 during such movement of the arm 21 which is quick, because a significant part of the overall contraction of the cylinder 33 has occurred before it begins. FIG. 2 shows that, when the hydraulic cylinder 33 is contracted fully, the support strut 31 extends below the horizontal and projects into the pit 11 below the arm 21, resting upon an angle support 34 which depends from the truck 14. The whole of the apparatus 10 is below the top of the rails 12 and 13 when stowed in the pit 11 so that the railway track is clear for through pasage of railway vehicles and for track maintenance.

An hydraulic buffer 35 is mounted in the pit 11 with its buffer plunger 36 urged into abutment with the end of the truck 14 that is nearer to the pivot mounting 32.

The geometry of the components mounted on the truck 14 is such that, when the hydraulic cylinder 33 is extended, the arm 21, which is not connected to the support strut 31 but which rests upon the end of the support strut 31, is supported by the support strut 31 in a position in which it locates the stop plate 27 in its operational location in the path of a central buffer of a railway vehicle moving on the railway track in the direction of arrow A in FIG. 1. The fixed stop 26 is an overtravel stop which is not intended to be abutted by any part of the arm 21 when the latter is positioned to locate the stop plate 27 in its operational location. The stop plate 27, the reinforcing strut 28, the reinforcing plates 29, the adjacent parts of the arm 21 and the support strut 31 form a path along which action and reaction forces due to a railway vehicle moving in the direction of Arrow A in FIG. 1 are transmitted between the stop plate 27 and the truck 14. The hydraulic cylinder 33 is not loaded by these forces since they are transmitted by the support strut 31 in compression. The kinetic energy of the moving vehicle is absorbed by the hydraulic buffer 35 to which it is transmitted via the truck 14.

The face of the stop plate 27 that is abutted by a buffer of a railway vehicle is shaped to form a central depression so that any buffer it receives, which would be articulated to its vehicle, is guided into a central location relative to the stop plate 27.

The collapsible movable buffer stop apparatus 10 comprising an arm, separate support strut and hydraulic cylinder mounted on a truck are useable without modification with any chosen size of hydraulic buffer 35. All that may be required to accommodate a larger buffer is excavation to enlarge the pit 11. The size of buffer would be chosen to suit the size of vehicle or vehicles to be stopped by the movable buffer stop apparatus 10.

The movable buffer stop apparatus comprising an arm, separate support strut and hydraulic cylinder need not be mounted on a truck which cooperates with a separate buffer. Indeed we prefer to use movable buffer stop apparatus which does not include such a truck as each of the pair of movable buffer stops that are located alongside each rail of the railway track, outside the track, for cooperation with side mounted railway vehicle buffers. FIGS. 4 to 9 show various forms of such movable buffer stop apparatus.

Figure 4:
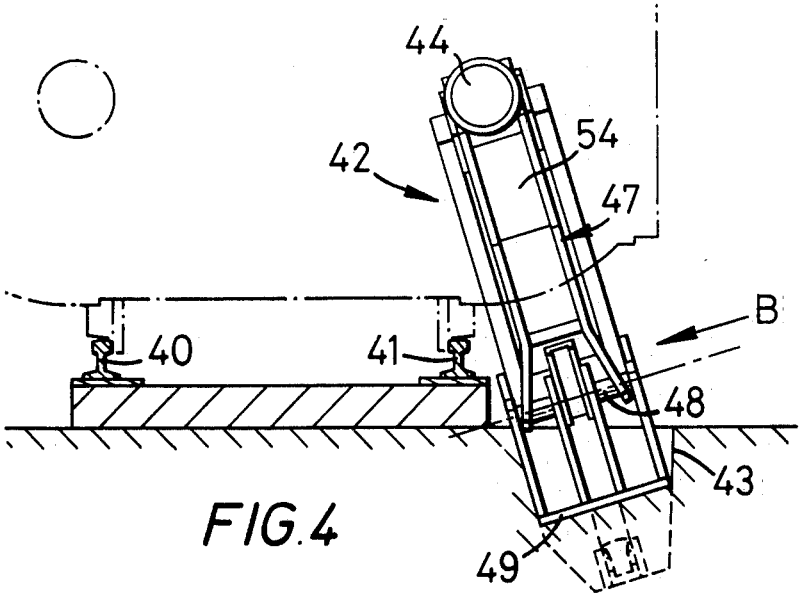
FIG. 4 is an end elevation of a movable buffer stop installation for a side mounted railway vehicle buffer, with the apparatus erected so that the stop is positioned in its operational location alongside a railway track.

FIG. 4 shows rails 40 and 41 of a railway track and movable stop apparatus 42 mounted in a pit 43 formed to one side of the track.

Figure 5:
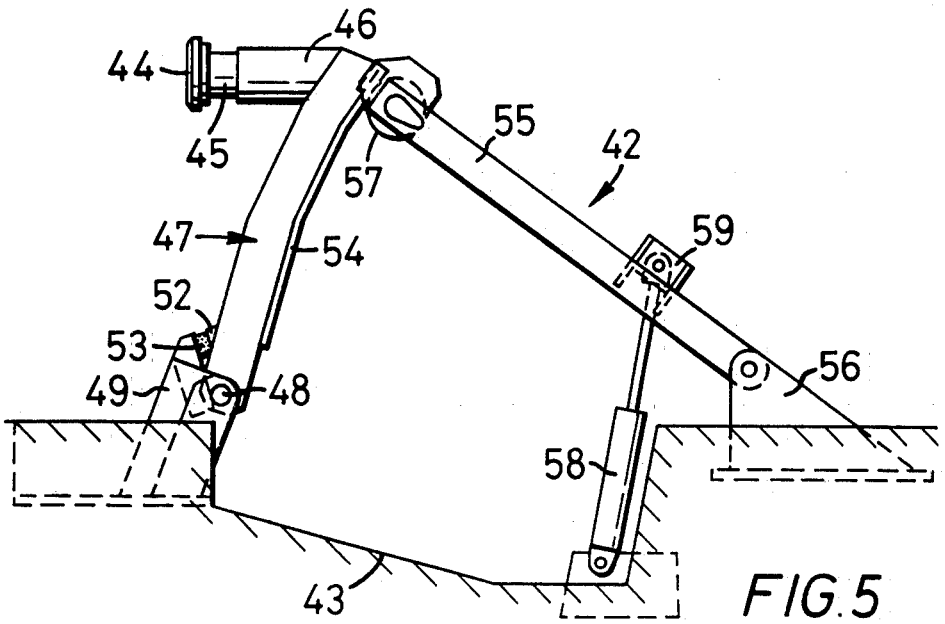
FIG. 5 is a side view of the movable buffer stop installation shown in FIG. 4 as seen in the direction of Arrow B in FIG. 4.

The apparatus 42 comprises a stop plate 44. FIG. 5 shows that the stop plate 44 is mounted on a buffer plunger 45 of an hydraulic buffer 46 which is mounted at one end of an arm 47.

The arm 47 is pivotally mounted on a pivot pin 48 which is supported by a pivot mounting 49 which is fixed to the ground at one end of the pit 43. The pivot pin 48 is orientated so that its pivot axis (shown chain-dotted in FIG. 4) is oblique to the horizontal, say at an angle of 16° to the horizontal. The arm 47 carries an abutment 52 (see FIG. 5) which abuts a fixed abutment 53 formed on the pivot mounting 49, to limit angular movement of the arm 47 in the anti-clockwise direction as seen in FIGS. 4 and 5.

The arm 47 is a fabricated structure generally of channel section. The base 54 is not flat but is formed from a number of juxtaposed flat portions which include shallow angles between them at their abutting edges when viewed from the side of the base 54 remote from the buffer 46. Hence the base 54 approximates to an arcuate base, forming a shallow substantially arcuate concave face.

A support strut 55 is pivotally mounted on a fixed mounting 56 which is located adjacent the end of the pit 43 remote from the pivot mounting 49. A roller 57 is pivotally mounted at the other end of the support strut 55. An hydraulic cylinder 58 has its cylinder casing pivotally mounted in the base of the pit 43 and its rod pivotally connected to the support strut 55 at a location 59 between the ends of the support strut 55 nearer the fixed mounting 56.

The geometry of the apparatus is such that, when the hydraulic cylinder 58 is extended (as shown in FIG. 5), the arm 47, which rests upon the roller 57, is supported by the support strut 55 in its operational location in which the longitudinal axis of the hydraulic buffer 46 is substantially horizontal. Hence the buffer 46 and the support strut 55 form a path along which action and reaction forces due to impact of the stop plate 44 by a respective side buffer of a railway vehicle are transmitted between the stop plate 44 and the fixed mounting 56. The hydraulic cylinder 58 is not loaded by these forces since they are transmitted by the support strut 55 in compression. The kinetic energy of the moving vehicle is absorbed in the hydraulic buffer 46.

The arm 47 follows angular movement of the support strut 55 from the operational location of the stop plate 44 shown in FIG. 5 to its stowing location (see FIG. 6) below the level of the rails 40 and 41 when the hydraulic cylinder 58 is contracted, the roller 57 running on the concave surface formed by the substantially arcuate base 54 of the arm 47. Significant portions of the arm 47, the buffer 46 and the support strut 55 are located within the pit 43 when the stop plate 44 is in its stowing location.

The arm 47 and the support strut 55 move angularly in a plane which is oblique to the vertical, making the same angle with the vertical as the pivot axis 51 makes with the horizontal.

Figure 6:
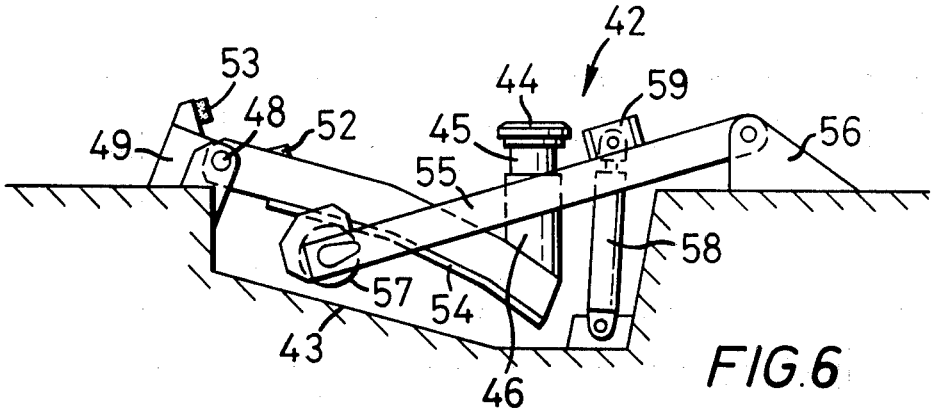
FIG. 6 is a side view in the direction of Arrow B in FIG. 4 of the movable buffer stop installation shown in FIG. 4, with the apparatus collapsed so that it is stowed out of the path of a moving railway vehicle on the respective track.
Figure 7:
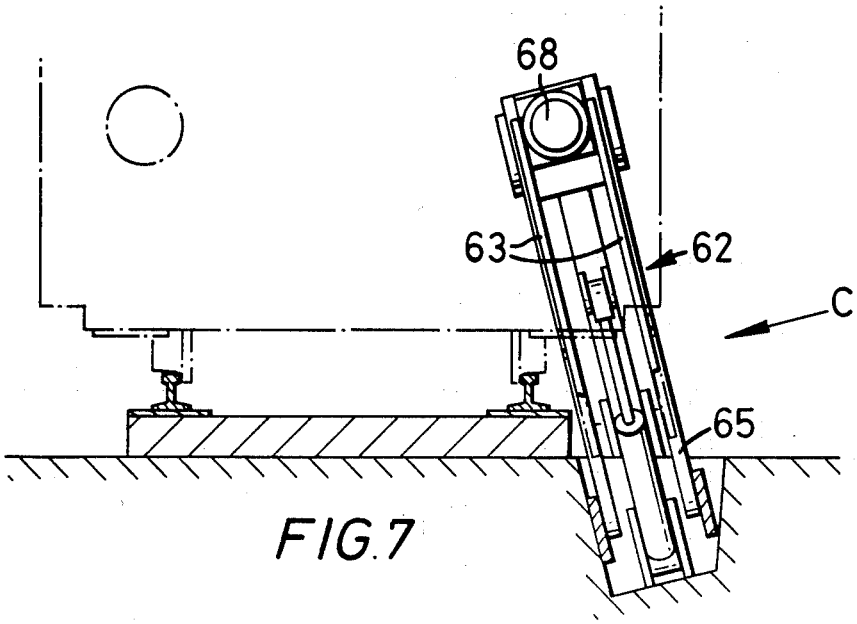
FIG. 7 is a view similar to FIG. 4 of another form of movable buffer stop installation for a side mounted railway vehicle buffer; the apparatus being shown erected.
Figure 8:
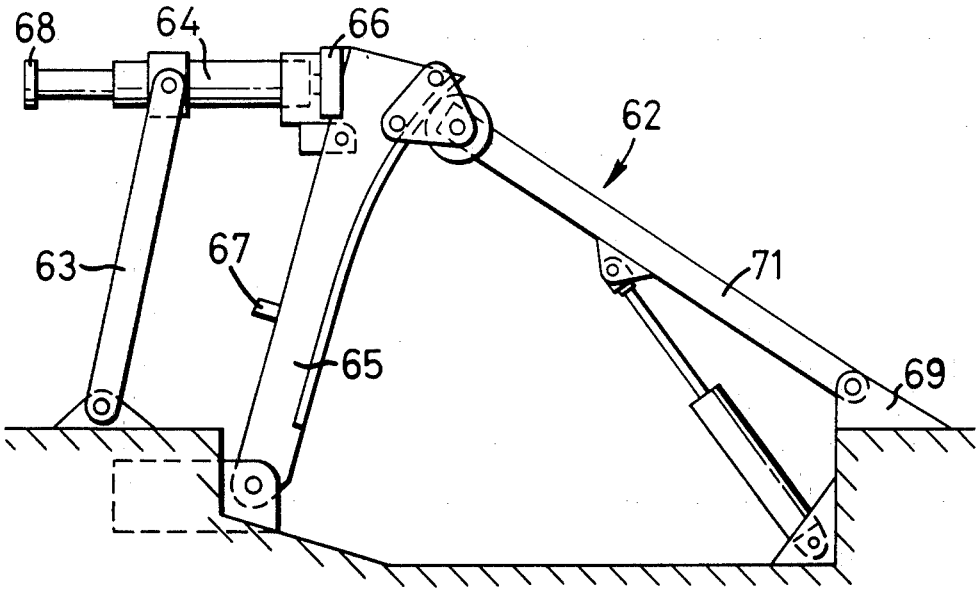
FIG. 8 is a view on Arrow C in FIG. 7.
Figure 9:
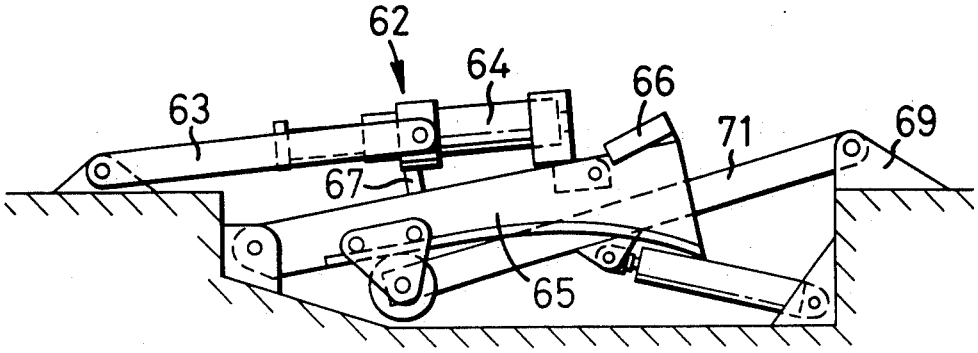
FIG. 9 is a view similar to FIG. 6 of the movable buffer stop installation shown in FIGS. 7 and 8, with the apparatus shown collapsed.

FIGS. 7, 8 and 9 illustrate another form of movable stop apparatus 62 which is generally similar to that illustrated in FIGS. 4 to 6. The apparatus 62 is modified as compared with the apparatus 42 by the provision of a slave link 63 which, together with the buffer 64, the arm 65 and the ground, forms a linkage similar to a parallelogram linkage. The design of the apparatus 62 allows use of longer buffers than can be supported by the apparaus 42. The buffer 64 is hinged to the arm 65. An abutment plate 66 is rigidly mounted on the arm 65 and provides a seat for the base of the buffer 64 when the apparatus is erected as shown in FIG. 8. A rest 67 projects from the arm 65 towards the slave link 63 and provides support for the buffer 64 when the apparatus 62 is collapsed. Hence action and reaction forces due to abutment of the stop plate 68 by a moving railway vehicle are transmitted between the stop plate 68 and the pivot mounting 69 of the support strut 71 via the buffer 64, the abutment plate 66 and the support strut 71.

Operation of the apparatus 10,42,62 may be controlled from a remote location to effect extension and contraction of the respective hydraulic cylinder 33, 58. The control system may be hydraulic or preferably is electro-hydraulic.

We claim:

1. Movable buffer stop apparatus (10) for a railway vehicle on a railway track, the apparatus (10) comprising an energy absorbing device (35) which is fixed relative to the track when the apparatus (10) is installed for use, a movable stop (27), a load bearing strut and actuating means operable, when the apparatus (10) is installed for use, to move the stop (27) generally in the direction of the track between an operational location in which it is located in the path of a railway vehicle on the track and in which it is associated with the load bearing strut such that impact of the stop (27) by a railway vehicle moving on the track is transmitted to the energy absorbing device (35) through the load bearing strut and taken by the energy absorbing device (35) in compression, and another location in which the apparatus (10) leaves the path clear for through passage of a railway vehicle and track maintenance, characterized in that the movable stop (27), the load bearing strut (31), and the actuating means are mounted on a truck (14) which, when the apparatus (10) is used, runs on a track which is sunken relative to the railway track, the truck (14) coacting with the energy absorbing device (35) so that energy transmitted to the truck (14) through the strut (31) as a result of impact of the stop (27) by a railway vehicle moving on the railway track is absorbed by the energy absorbing device (35), and the actuating means are operable to move the stop (27) into its operational location by moving the strut (31) into a position in which it transmits impact forces to the truck (14) in compression without the actuating means being loaded by those forces.

2. Movable buffer stop apparatus (10) according to claim 1, wherein the stop (27) is carried by an arm (21) which is supported by the strut (31) to position the stop (27) in its operational location, the strut (31) being positioned by the actuating means which comprise a linear actuator.

3. Movable buffer stop apparatus (10) according to claim 2, wherein the strut (31) is pivotally mounted for angular movement about an axis which is spaced from a part of it which supportingly engages the arm (21), that strut part being in rubbing contact with the arm (21) at least when the stop (27) is in its operational location, and the arm (21) rests upon the strut (31) so that it is raised and lowered by angular movement of the strut (31).

4. Movable buffer stop apparatus (10) according to claim 3, wherein that part (25) of the arm (21) with which the strut (31) is supportingly engaged when the stop (27) is in its operational location is configured such that there is substantially no movement of the arm (21) as the strut (31) moves through a major part of its total angular movement to and from its limit location in which it supports the arm (21) to position the stop (27) in its operational location so that the arm (21) moves quickly to displace the stop (27) from its operational location.

5. Movable bufer stop apparatus (10) according to claim 3, wherein the linear actuator is a pivotally mounted hydraulic cylinder (33) which is pinned to the strut (31) between said arm engaging part of the strut (31) and the pivot mounting (32) of the strut (31).

6. Movable buffer stop apparatus (10, 42, 62) for a railway vehicle, comprising a stop (27, 44, 68) which is carried by an arm (21, 47, 65) which is movable between one position in which the stop (27, 44, 68) is located in an operational location in the path of a railway vehicle, and a second position in which it leaves that path clear for through passage of a railway vehicle and for track maintenance, the arm (21, 47, 65) being supported in said one position by a strut (31, 55, 71) which is positioned by a linear actuator such that, when the stop apparatus (10, 42, 62) is installed for use, action and reaction forces due to impact of the stop (27, 44, 68) by a railway vehicle are transmitted between the stop (27, 44, 68) and ground structure which is fixed relative to the rails on which the vehicle runs through the stop (27, 44, 68) and the strut (31, 55, 71), as well as through an associated energy absorbing device (35, 46, 64), generally in the direction of movement of the vehicle without the linear actuator being loaded by those forces, wherein the strut (31, 55, 71) is pivotally mounted for angular movement about an axis which is spaced from a part of it which supportingly engages the arm (21, 47, 65), that strut part being in rubbing contact with the arm (21, 47, 65) at least when the arm (21, 47, 65) is in said one position, and the arm (21, 47, 65) resting upon the strut (31, 55, 71) so that it is raised and lowered between said one position and its second position by angular movement of the strut (31, 55, 71).

7. Movable buffer stop apparatus (10, 42, 62) according to claim 6, wherein the linear actuator is a pivotally mounted hydraulic cylinder (33, 58) which is pinned to the strut (31, 55, 71) between said arm engaging part of the strut (32, 56, 69) and the pivot mounting of the strut (31, 55, 71).

8. Movable buffer stop apparatus (10, 42, 62) according to claim 6, wherein that part of the arm (21, 47, 65) with which the strut (31, 55, 71) is supportingly engaged when the stop (27, 44, 68) is in its operational location is configured such that there is substantially no movement of the arm (21, 47, 65) as the strut (31, 55, 71) moves through a major part of its total angular movement to and from its limit locations in which it supports the arm (21, 47, 65) to position the stop (27, 44, 68) in its operational location so that the arm (21, 47, 65) moves quickly to displace the stop (27, 44, 68) from its operational location.

9. Movable buffer stop apparatus (42, 62) according to claim 6, wherein the pivot mountings (49 and 56, 69) for the arm (47, 65) and the strut (55, 71), and the mounting for the linear actuator are adapted to be fixed relative to the rails (40 and 41) when the apparatus (42, 62) is installed for use.

10. Movable buffer stop apparatus (42, 62) according to claim 9, wherein the stop (44, 68) is carried by the energy absorbing device (46, 64) which is mounted on the arm (47, 65).

11. Movable buffer stop apparatus (42, 62) according to claim 9, which is one of a pair which are adapted to be installed on either side of a railway track, the stop (44, 68) of each apparatus (42, 62) being adapted to cooperate with a respective one of a pair of buffers which are mounted on a railway vehicle which runs on the track, one buffer being at either side of the vehicle.

12. Movable buffer stop apparatus (42, 62) according to claim 11 wherein the fixed mountings (49 and 56, 69) for the arm (47, 65), the strut (55, 71) and the linear actuator of each apparatus (42, 62) are adapted to be outside the respective railway track alongside the adjacent rail (40, 41) when the apparatus (42, 62) is installed for use and so that angular movement of the arm (47, 65) and the strut (55, 71) is in a plane which is oblique to the vertical.

13. Movable buffer stop apparatus (10) according to claim 6, which is adapted to cooperate with a single buffer which is mounted centrally on the railway vehicle, wherein the arm (21), the strut (31) and the linear actuator are mounted on a truck (14) which is adapted to run on a sunken track between the rails (12 and 13) of the respective railway track, the energy absorbing device (35) cooperating with the truck (14) and being adapted to be fixedly mounted between the truck (14) and said fixed structure when the apparatus (10) is installed for use.

* * * * *